US008689386B2

(12) United States Patent
Patel et al.

(10) Patent No.: US 8,689,386 B2
(45) Date of Patent: Apr. 8, 2014

(54) SUBSEA CONDUIT CLEANING SKID

(75) Inventors: Nikunj Patel, Houston, TX (US); Noah Teichmiller, Houston, TX (US); Kinton Lawler, Fulshear, TX (US)

(73) Assignee: Oceaneering International, Inc., Houston, TX (US)

( * ) Notice: Subject to any disclaimer, the term of this patent is extended or adjusted under 35 U.S.C. 154(b) by 1161 days.

(21) Appl. No.: 12/501,414

(22) Filed: Jul. 11, 2009

(65) Prior Publication Data

US 2010/0180915 A1 Jul. 22, 2010

Related U.S. Application Data

(60) Provisional application No. 61/146,562, filed on Jan. 22, 2009.

(51) Int. Cl.
*B08B 7/00* (2006.01)

(52) U.S. Cl.
USPC ..... 15/88; 15/1.7; 15/104.04

(58) Field of Classification Search
USPC ..... 15/88, 104.04, 1.7, 50.3, 52.1, 53.2; 405/211
See application file for complete search history.

(56) References Cited

U.S. PATENT DOCUMENTS

| | | | | |
|---|---|---|---|---|
| 1,008,669 | A | 11/1911 | Nixon | |
| 1,036,907 | A | 8/1912 | Reynolds | |
| 1,134,881 | A | 4/1915 | Lockwood | |
| 1,266,050 | A | 5/1918 | Reynolds | |
| 1,279,732 | A | 9/1918 | Lockwood | |
| 4,290,820 | A * | 9/1981 | Swisher et al. | 134/6 |
| 4,676,692 | A | 6/1987 | Henderson | |
| 5,979,001 | A * | 11/1999 | Marrero | 15/53.1 |
| 6,798,090 | B2 | 9/2004 | Cheung et al. | |
| 2008/0135232 | A1 | 6/2008 | Lawler et al. | |
| 2009/0178216 | A1 | 7/2009 | Lawler et al. | |

FOREIGN PATENT DOCUMENTS

GB 2246381 A * 1/1992

OTHER PUBLICATIONS

Saab Seaeye Ltd. Brochure, "Cougar XT The Compact Work ROV", 2007, 6 pages.

* cited by examiner

*Primary Examiner* — Shay Karls
(74) *Attorney, Agent, or Firm* — Gary R. Maze; Berenbaum Weinshienk, PC

(57) ABSTRACT

The invention described herein is directed to a skid for cleaning subsea conduits, such as strakes and fairings, and a method of cleaning subsea conduits. This invention may be utilized for the removal of marine growth from subsea conduits.

10 Claims, 10 Drawing Sheets

SUBSEA CONDUIT CLEANING SKID

CROSS-REFERENCE TO RELATED APPLICATION

This application claims the benefit of Provisional Application 61/146,562, filed Jan. 22, 2009.

FIELD OF THE INVENTION

The invention described herein is directed to a skid for cleaning subsea conduits, such as strakes and fairings, and a method of cleaning subsea conduits. This invention may be utilized for the removal of marine growth from subsea conduits.

BACKGROUND OF THE INVENTION

The cleaning of subsea conduits, such as strakes and fairings, is currently performed by a remotely operated vehicle ("ROV") manipulator using a water blaster. This is a slow and inefficient method.

Strakes and fairings must be continuously cleaned to maintain their vortex induced vibration ("VIV") suppression performance. The invention described herein provides the ability to simultaneously clean opposite sides of a subsea conduit using an ROV, thereby precluding the need to circumnavigate the entire outer circumference of the subsea conduit with the ROV, as shown in FIG. 6. The invention described herein provides a faster method of cleaning subsea conduits, such as strakes and fairings, resulting in less vessel time and less remote, as shown in FIG. 6*ly* operated vehicle ("ROV") time, thereby achieving a cost savings.

The invention disclosed herein is particularly well suited to cleaning vertically oriented subsea conduits because it employs brushes comprising abrasive elements rotatable about an axis that is substantially parallel to the axis of the conduit being cleaned, as shown in FIG. 6. This permits an ROV comprising the invention disclosed herein to ascend or descend in a direction substantially parallel to the axis of the conduit being cleaned, while the abrasive brush elements rotate against the outer surface of the conduit on multiple sides of such conduit, as shown in FIG. 6. This provides a major advantage in time required to clean such subsea conduit over an apparatus that employs only a small single brush.

DETAILED DESCRIPTION OF PREFERRED EMBODIMENTS

One group of embodiments of the invention disclosed herein is directed to a strake cleaning skid that is designed to fit on an ROV, for use in cleaning subsea conduits, such as strakes or fairings. Another group of embodiments of the invention disclosed herein is directed to methods of cleaning a subsea conduit using strake cleaning skid attached to an ROV.

Figure 1:
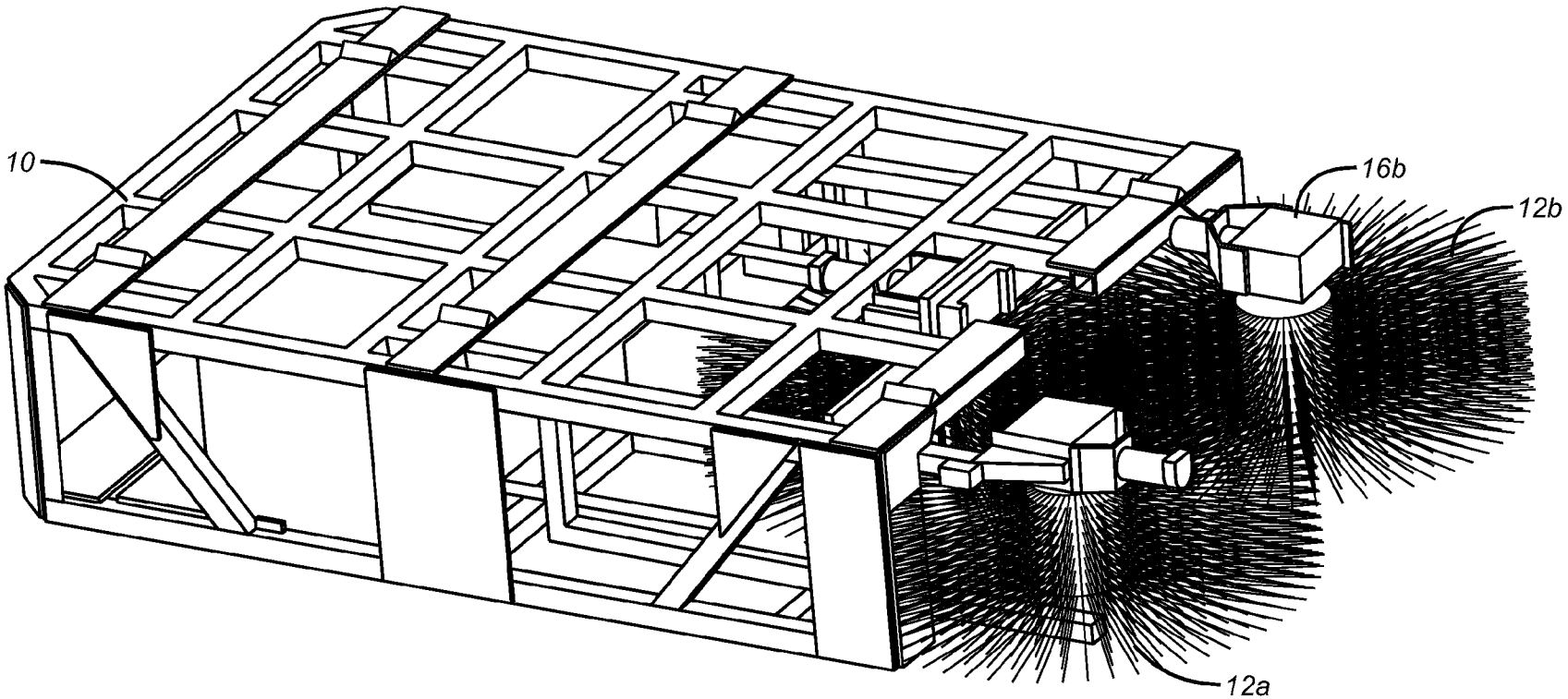
FIG. 1 is an isometric view of an embodiment of the invention described herein with brushes retracted.
Figure 9A:
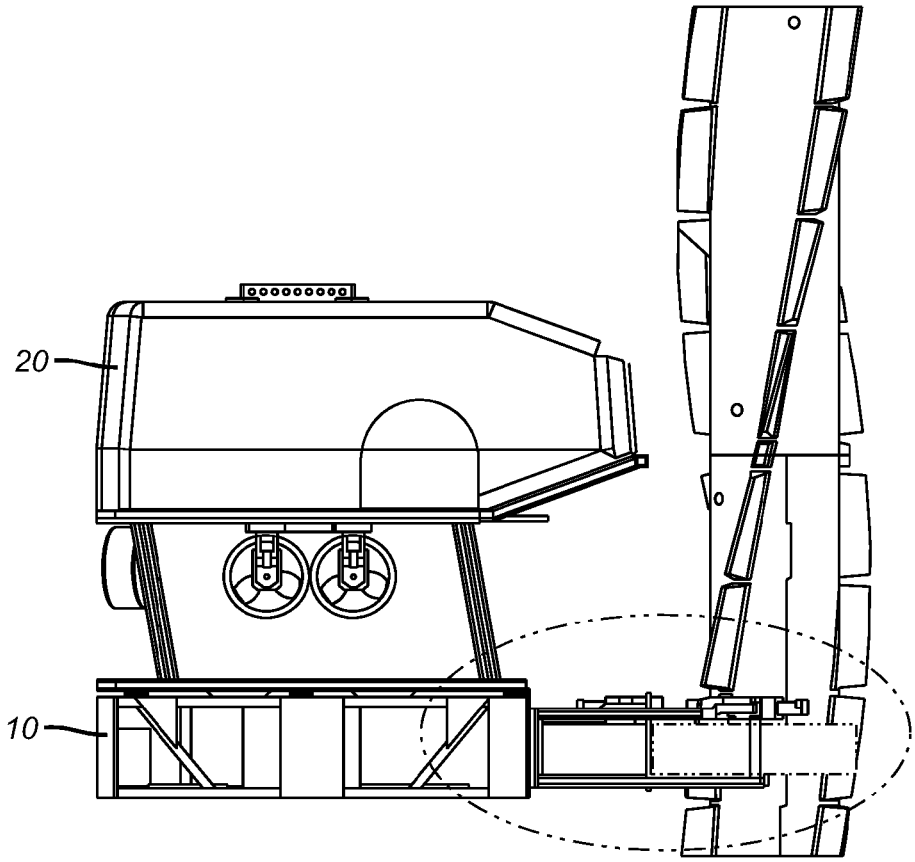
FIG. 9*a* is a side view of a preferred embodiment of the invention described herein cleaning a strake.
Figure 9B:
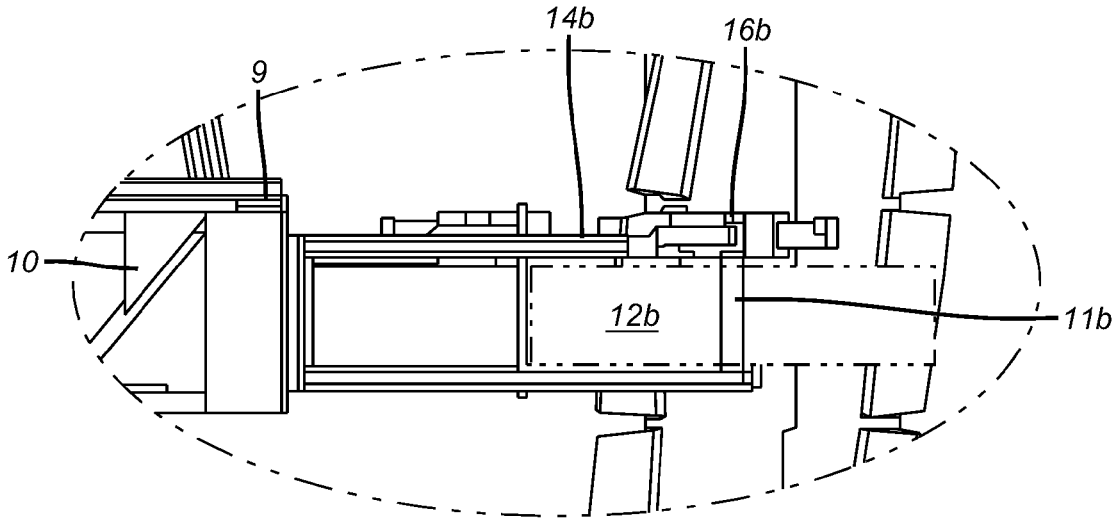
FIG. 9*b* is a side view of a portion of a preferred embodiment of the invention shown in the FIG. 9*a*.
Figure 10:
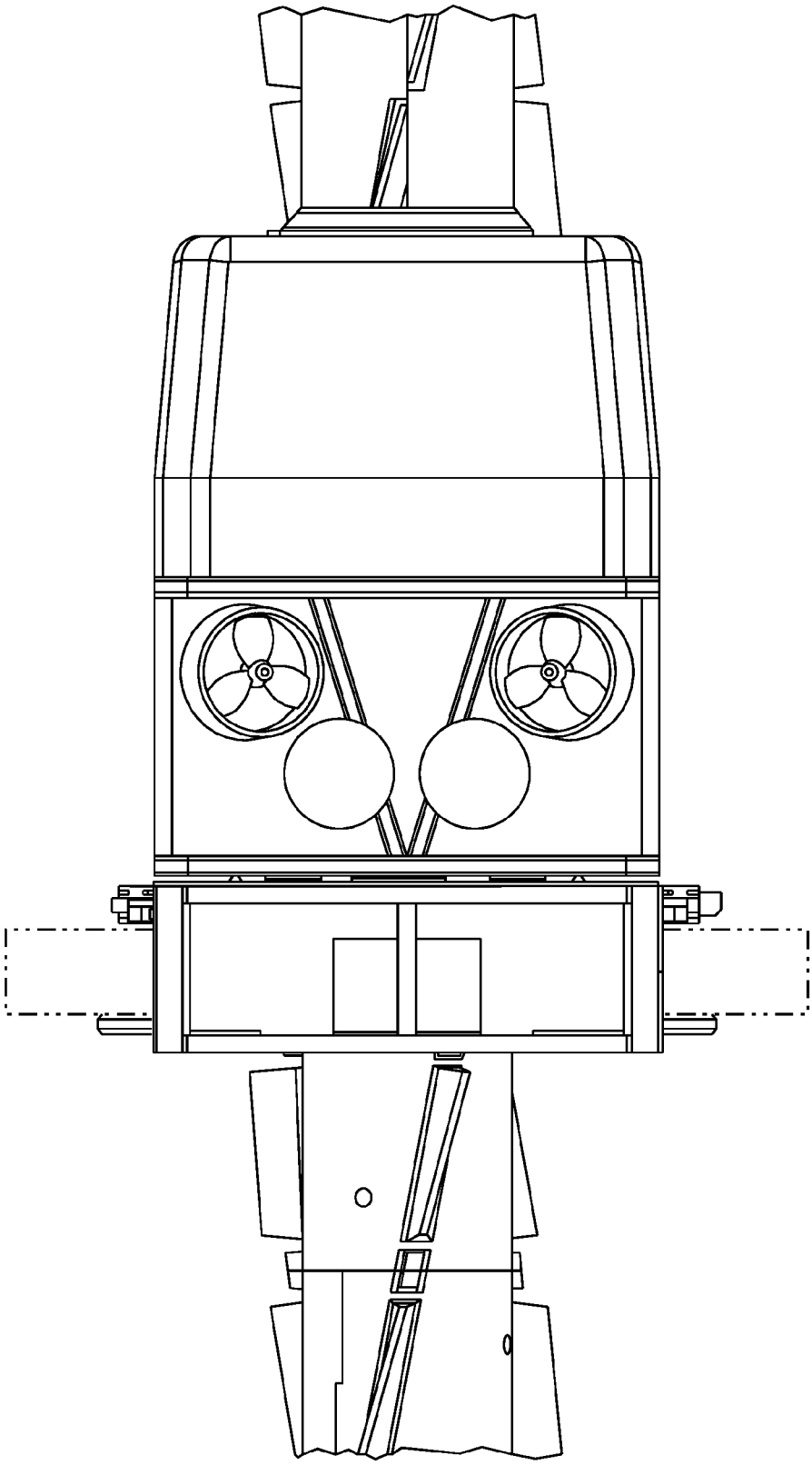
FIG. 10 is a rear view of an embodiment of the invention disclosed herein with brushes in an extended and open configuration.
Figure 11:
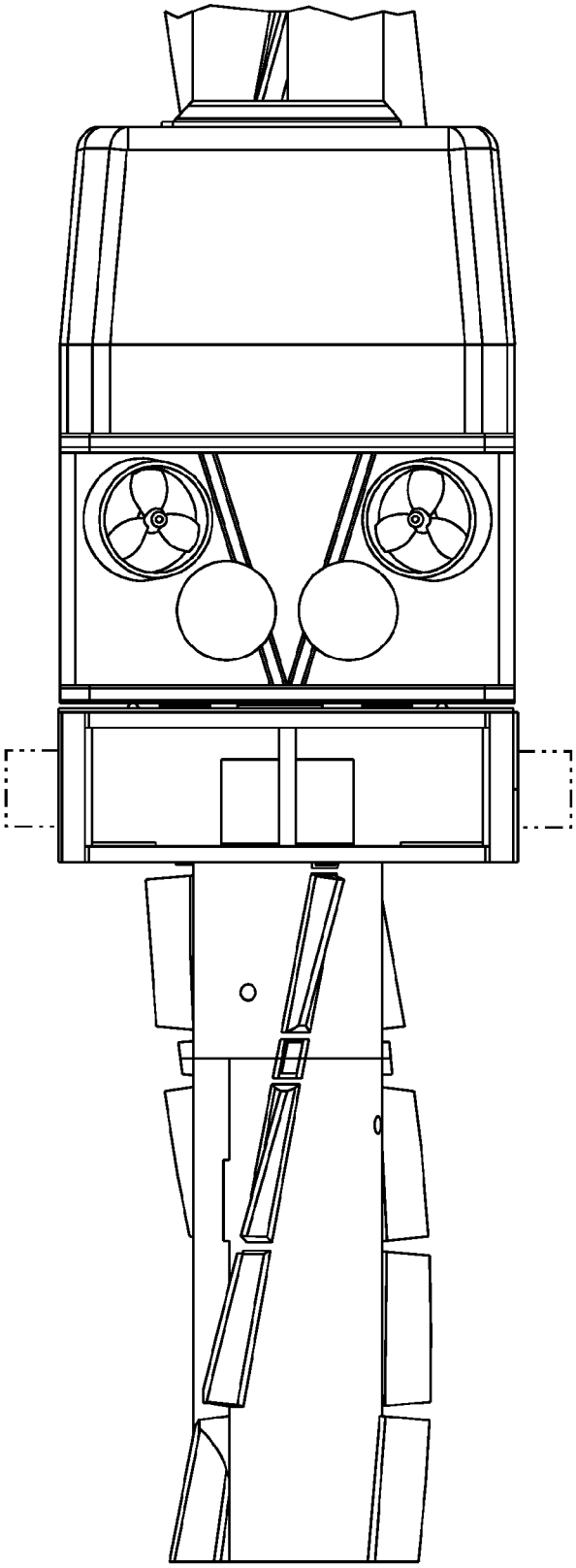
FIG. 11 is a rear view of an embodiment of the invention disclosed herein cleaning a strake.

In one preferred embodiment, the invention comprises a frame 10 comprising a front region, a rear region opposite the front region, and a top region 9 defining a top planar surface, as shown in FIGS. 1 and 9B. This embodiment of the invention further comprises a first arm 14*a* mounted on the front region of the frame and a second arm 14*b* mounted on the front region of the frame, as shown in FIG. 3. In a preferred embodiment, the first arm and second arm are each pivotally mounted to the frame. In another preferred embodiment, the first arm and the second arm are each extendably and retractably mounted to the frame. The arms are depicted in a retracted configuration in FIGS. 1 and 2, and in an extended configuration in FIG. 3.

This embodiment of the invention further comprises a first brush rotational axis 11*a* rotatably mounted on the first arm in an orientation substantially perpendicular to the top planar surface, and a second brush rotational axis 11*b* rotatably mounted on the second arm in an orientation substantially perpendicular to the top planar surface, as shown in FIGS. 9A-9B. In a preferred embodiment, the first and second brushes abrasive elements extend outward in a substantially circular configuration, as shown in FIGS. 1-5.

Figure 2:
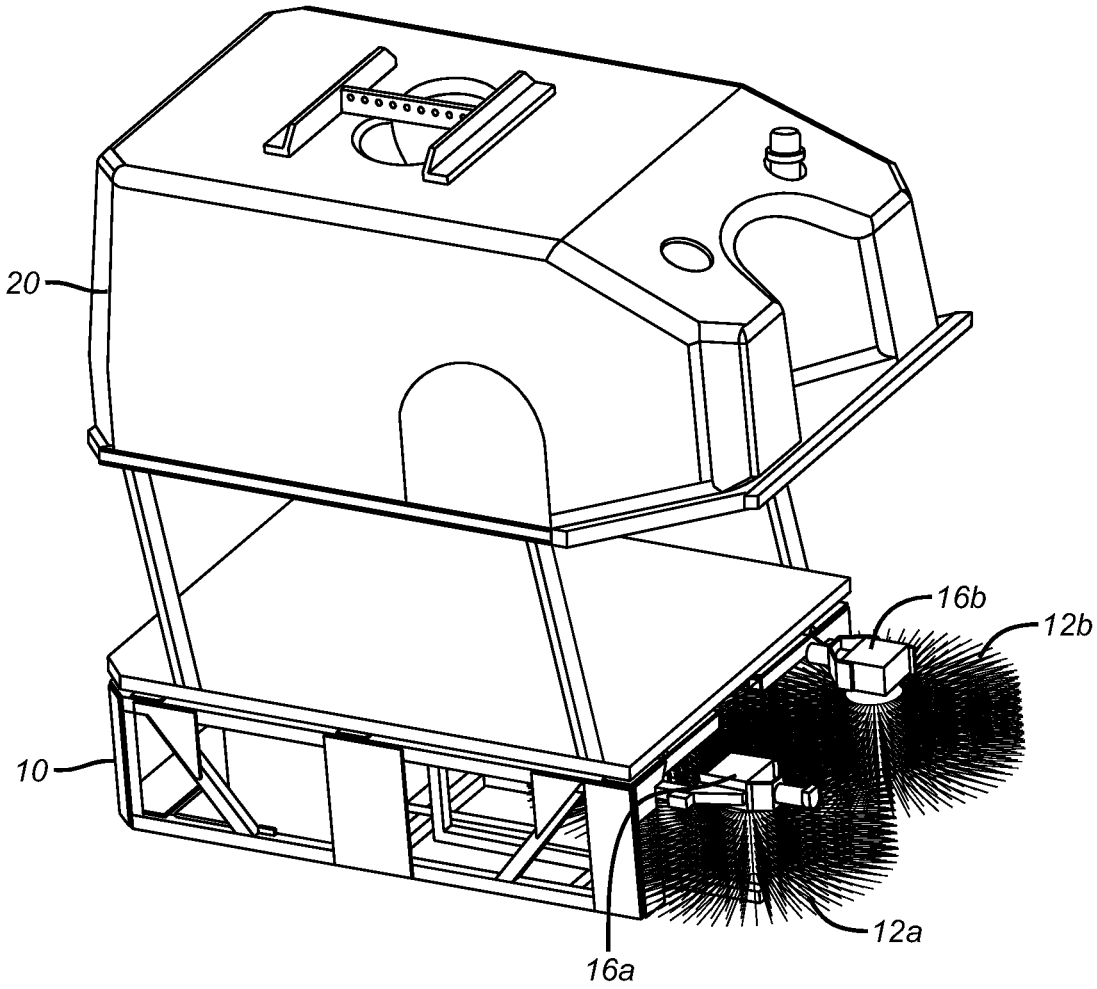
FIG. 2 is an isometric view of an embodiment of the invention described herein with brushes retracted.
Figure 3:
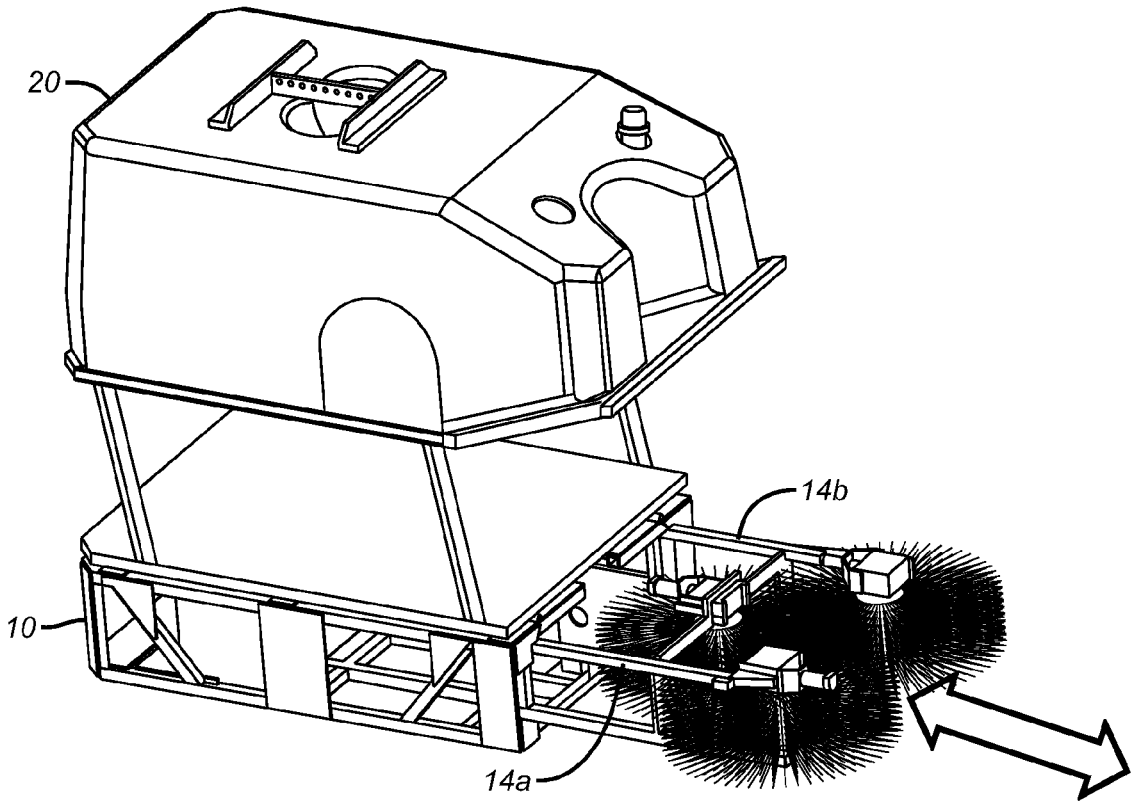
FIG. 3 is an isometric view of an embodiment of the invention described herein with brushes extended.

This embodiment of the invention further comprises a first motor 16*a* operatively coupled to rotate the first brush rotational axis and a second motor 16*b* operatively coupled to rotate the second brush rotational axis, as shown in FIGS. 1-2. This embodiment of the invention further comprises a plurality of first brush abrasive elements 12*a* attached to, and extending radially outward from, the first brush rotational axis, and a plurality of second brush abrasive elements 12*b* attached to, and extending radially outward from, the second brush rotational axis brush rotational axis.

In another preferred embodiment, the invention further comprises an ROV 20 connected to the top of the frame, as shown in FIGS. 2-4, 7, 9*a*, and 10-11. The arms can retract and extend from skid for easy deployment. The skid fits on the bottom of ROV as shown in FIG. 2. When the ROV deploys for operation the brushes are retracted, as shown in FIG. 1.

Figure 4:
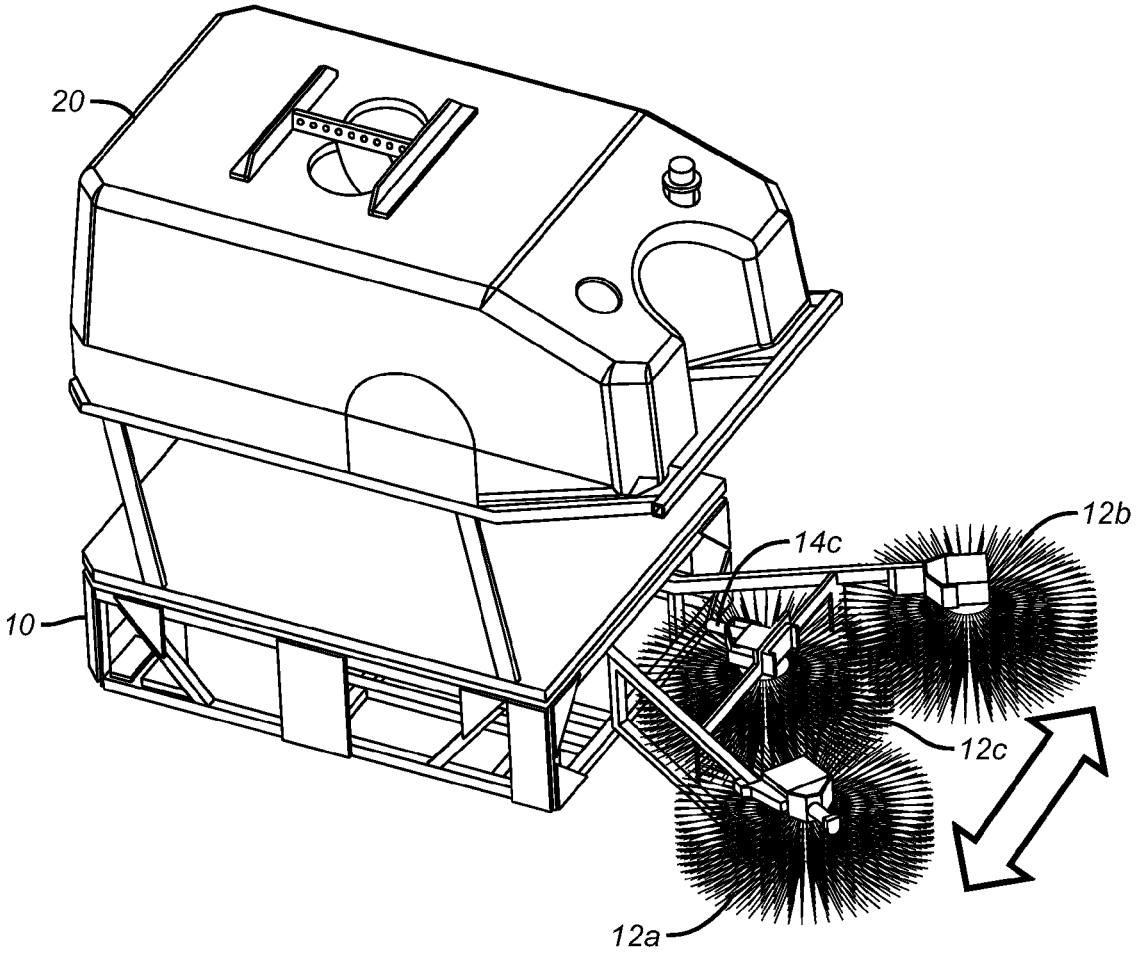
FIG. 4 is an isometric view of an embodiment of the invention described herein with brushes in an extended and open configuration.

Another preferred embodiment of the invention further comprises a third arm 14*c* mounted on the frame between the first and second arms, as shown in FIG. 4, and a third brush rotational axis 11*c* rotatably mounted on the third arm. This embodiment further comprises a third plurality of third brush abrasive elements 12*c* attached to, and extending radially outward from, the third brush rotational axis, as shown in FIG. 4. In a preferred embodiment, the third brush abrasive elements extend outward in a substantially circular configuration, as shown in FIG. 4.

In a preferred embodiment, the third arm is pivotally mounted to the frame. In another preferred embodiment, the third arm is extendably and retractably mounted to the frame, as shown in FIGS. 2-3. This embodiment further comprises a third motor 16*c* operatively coupled to rotate the third brush rotational axis.

Method embodiments of the invention disclosed herein are directed to methods of cleaning a subsea conduit 21. In one embodiment, the conduit comprises fins 22. A first method embodiment comprises piloting a remotely operated vehicle with a skid mounted beneath it toward a subsea conduit having a longitudinal axis. The skid comprising at least two motorized brushes, each of which is mounted on a rotational axis that is rotatably mounted to an arm pivotally mounted to the skid, as shown in FIG. 2. In a second method embodiment, the skid comprises at least two outer motorized brushes and a center motorized brush, each of which is mounted on a rotational axis that is rotatably mounted to an arm that is mounted to the skid, as shown in FIG. 3.

Figure 5:
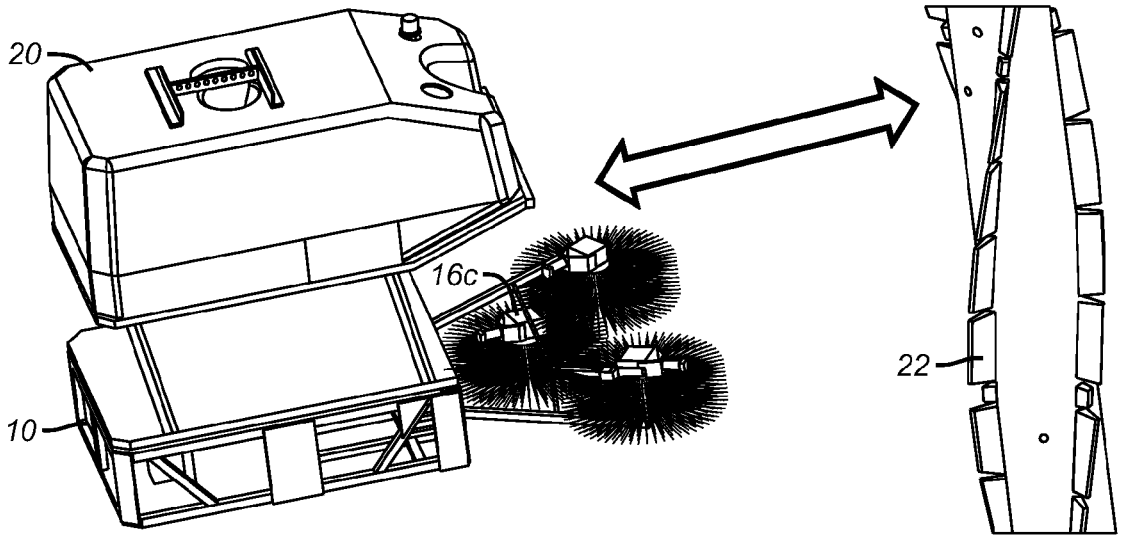
FIG. 5 is an isometric view of an embodiment of the invention described herein approaching a strake.

Once the ROV gets near the subsea conduit to be cleaned, the first and second methods further comprise extending the arms in front of the skid, as shown in FIG. 3. The first method further comprises pivotally opening the arms, or swinging them outward a sufficient amount to allow the brushes to contact opposite sides of the subsea conduit, as shown in FIGS. 4-5. The second method comprises pivotally opening the arms to which the two outer motorized brushes are attached a sufficient amount to allow the two outerbrushes to contact opposite sides of the subsea conduit, as shown in FIGS. 4-5. The angle of swing is determined by size of subsea conduit.

Figure 6:
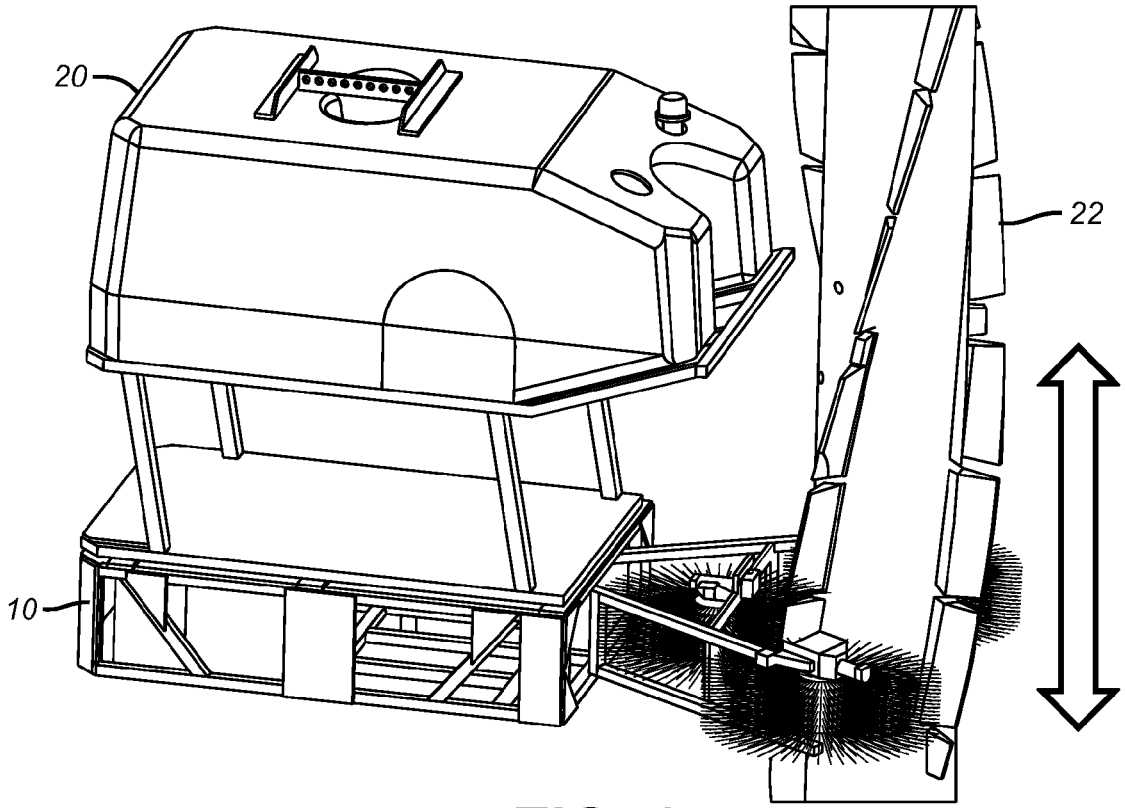
FIG. 6 is an isometric view of an embodiment of the invention described herein being used to clean a strake.
Figure 7:
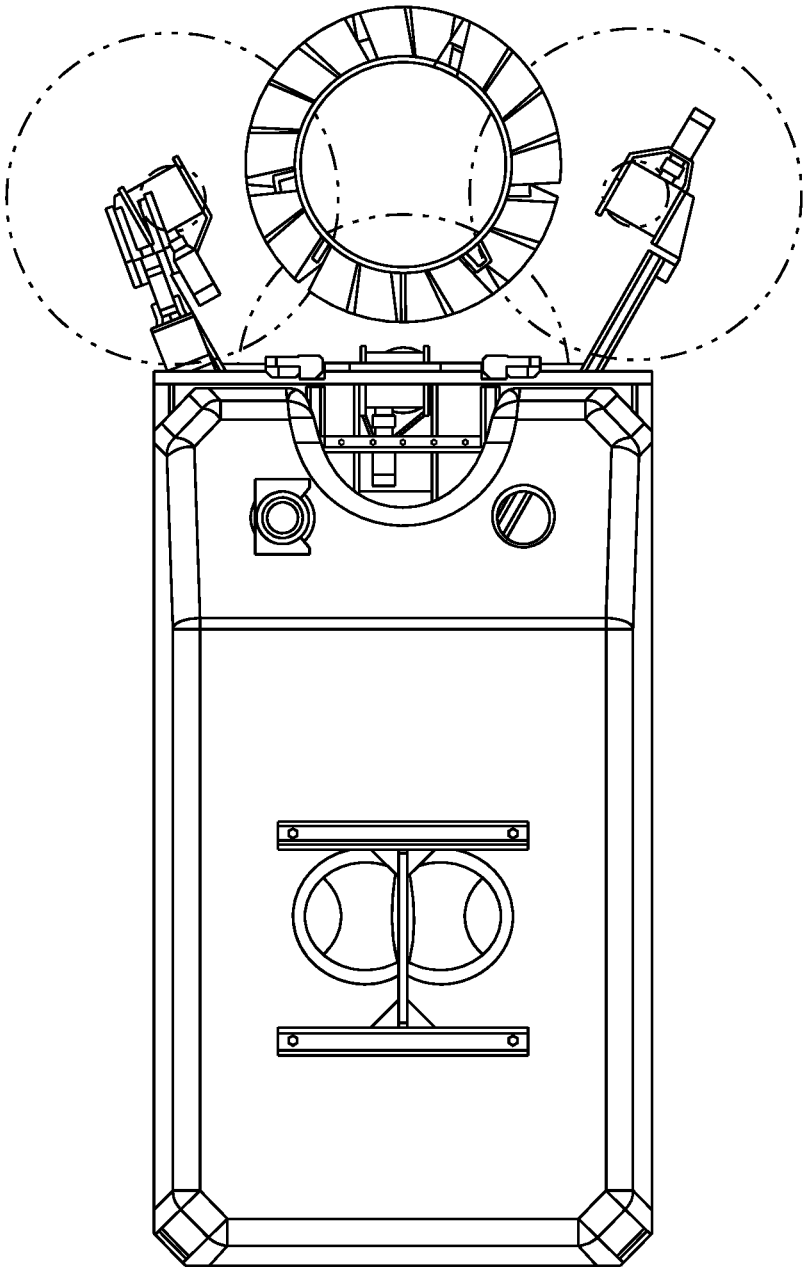
FIG. 7 is a top view of an embodiment of the invention described herein cleaning a strake.

The first and second methods further comprise operating the motors to rotate each brush about its rotational axis, as shown in FIG. 5, and operating the motors to rotate the brushes, as shown in FIG. 6.

Figure 8:
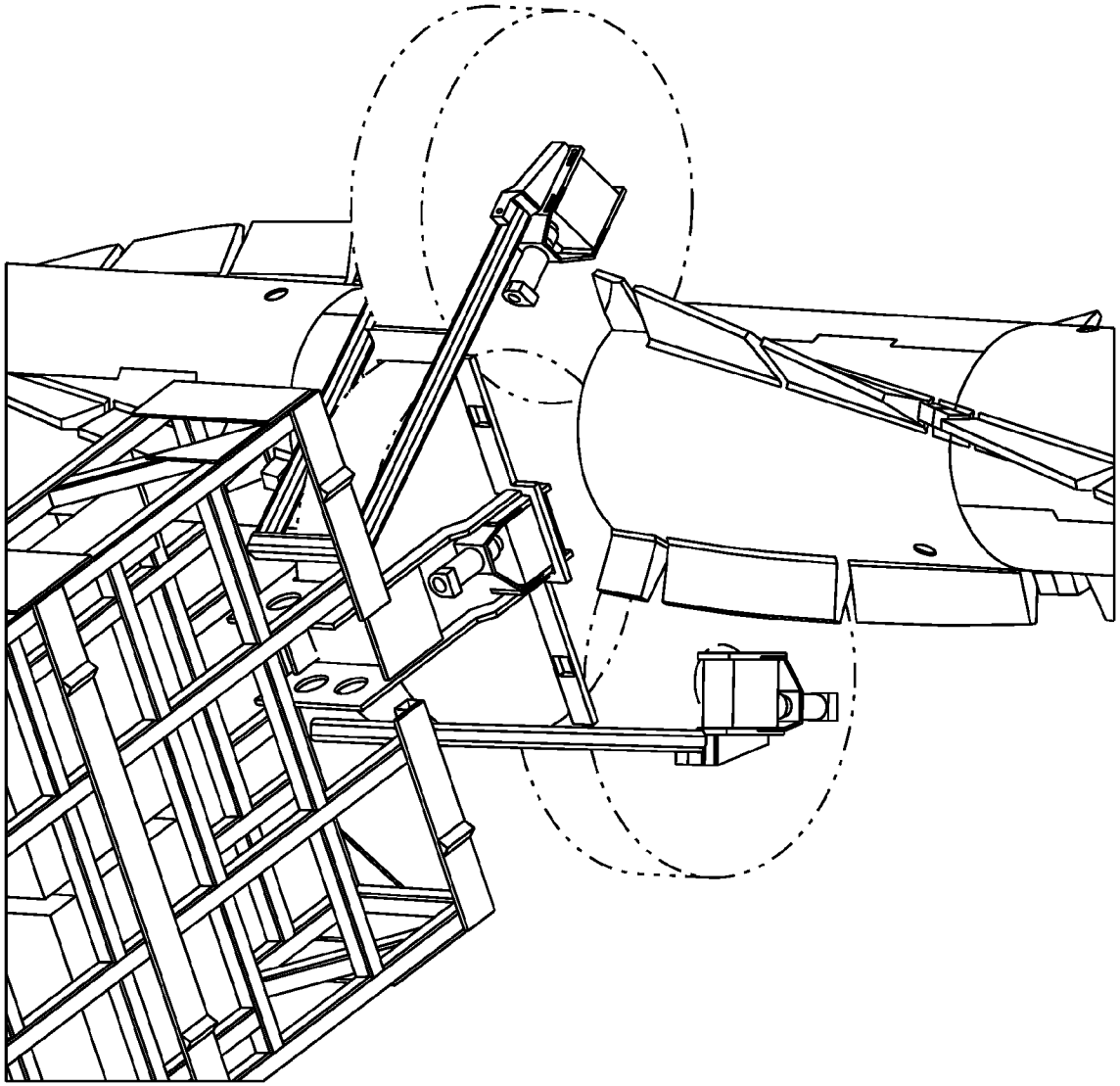
FIG. 8 is a partial isometric view of an embodiment of the invention described herein cleaning a strake.

The first and second methods further comprise positioning the remotely operated vehicle and skid such that the rotating brushes abrasively clean opposite sides of the conduit with the rotational axes oriented substantially parallel to the longitudinal axis of the subsea conduit, as shown in FIGS. 6 and 8.

In a preferred embodiment, the first and second methods further comprise piloting the remotely operated vehicle in a direction substantially parallel to the longitudinal axis of the subsea conduit being cleaned, such that the rotating brushes abrasively clean the conduit along its length. This may be accomplished by having the ROV thrust up and down in proper sequence to clean the strakes as shown in FIG. 6.

In a preferred embodiment, the first and second methods further comprise ceasing the rotation of the brushes; and retracting the arms such that the brushes are no longer in contact with the subsea conduit.

In a preferred embodiment, the first and second methods further comprise piloting the remotely operated vehicle away from the subsea conduit that was cleaned by the brushes.

The foregoing disclosure and description of the inventions are illustrative and explanatory. Various changes in the size, shape, and materials, as well as in the details of the illustrative construction and/or a illustrative method may be made without departing from the spirit of the invention.

What is claimed is:

1. A conduit cleaning skid comprising:

a. a frame dimensioned to be connected to a remotely operated vehicle, the frame comprising a front region, a rear region opposite the front region, and a top region defining a top planar surface, the front region, rear region, and top region defining a substantially open inner portion;

b. a first arm selectively movably mounted to the front region of the frame at least partially within the substantially open inner portion;

c. a second arm selectively movably mounted to the front region of the frame at least partially within the substantially open inner portion, the second arm cooperatively movable with respect to the first arm;

d. a first brush rotational axis rotatably mounted on the first arm in an orientation substantially perpendicular to the top planar surface;

e. a second brush rotational axis rotatably mounted on the second arm in an orientation substantially perpendicular to the top planar surface;

f. a first motor operatively coupled to rotate the first brush rotational axis;

g. a second motor operatively coupled to rotate the second brush rotational axis;

h. a plurality of first brush abrasive elements attached to, and extending radially outward from, the first brush rotational axis; and i. plurality of second brush abrasive elements attached to, and extending radially outward from, the second brush rotational axis.

2. The conduit cleaning skid of claim 1, wherein at least one of the first arm and second arm is additionally pivotally mounted to the frame.

3. The conduit cleaning skid of claim 1, wherein the first arm and second arm are extendably and retractably mounted within the substantially open inner portion of the frame.

4. The conduit cleaning skid of claim 1, wherein the first and second brush abrasive elements extend outward in a substantially circular configuration.

5. The conduit cleaning skid of claim 1, further comprising a remotely operated vehicle connected to the top of the frame.

6. A conduit cleaning skid comprising:

a. a frame adapted to be connected to a remotely operated vehicle, the frame comprising a front region, a rear region opposite the front region, and a top region defining a top planar surface, and the front region, rear region, and top region defining a substantially open inner portion;

b. a first arm selectively movably mounted on the front region of the frame at least partially within the substantially open inner portion;

c. a second arm selectively movably mounted on the front region of the frame at least partially within the substantially open inner portion, the second arm cooperatively movable with respect to the first arm;

d. a third arm mounted between the first and second arms;

e. a first brush rotational axis rotatably mounted on the first arm in an orientation substantially perpendicular to the top planar surface;

f. a second brush rotational axis rotatably mounted on the second arm in an orientation substantially perpendicular to the top planar surface;

g. a third brush rotational axis rotatably mounted on the third arm in an orientation substantially perpendicular to the top planar surface;

h. a first motor operatively coupled to rotate the first brush rotational axis;

i. a second motor operatively coupled to rotate the second brush rotational axis;

j. a third motor operatively coupled to rotate the third brush rotational axis;

k. a plurality of first brush abrasive elements attached to, and extending radially outward from, the first brush rotational axis;

l. a plurality of second brush abrasive elements attached to, and extending radially outward from, the second brush rotational axis; and m. a plurality of third brush abrasive elements attached to, and extending radially outward from, the third brush rotational axis.

7. The conduit cleaning skid of claim 6, wherein at least one of the first arm and the second arm is additionally pivotally mounted to the frame.

8. The conduit cleaning skid of claim 6, wherein the first arm, the second arm, and the third arm are each extendably and retractably mounted to the frame with respect to a plane defined by the substantially open inner portion of the frame.

9. The conduit cleaning skid of claim 6, wherein the first, second, and third brush abrasive elements extend outward in a substantially circular configuration.

10. The conduit cleaning skid of claim 6, further comprising a remotely operated vehicle connected to the top of the frame.

* * * * *